United States Patent [19]

Tsai

[11] Patent Number: 4,625,639

[45] Date of Patent: Dec. 2, 1986

[54] CONTINUOUS, MULTI-CHROMATIC AND MULTI-PRODUCTIVE PRESS

[76] Inventor: Chien F. Tsai, 39, Alley 15, An Tou Lane, Yen Ping Li, Changhua City, Taiwan

[21] Appl. No.: 730,648

[22] Filed: May 6, 1985

[51] Int. Cl.[4] ..... B41F 5/02; B41F 21/04

[52] U.S. Cl. ..... 101/181; 101/DIG. 27

[58] Field of Search ..... 101/171, 174, 181, 183, 101/184, DIG. 27, 212, 216, 135, 136, 141

[56] References Cited

U.S. PATENT DOCUMENTS

| | | | |
|---|---|---|---|
| 2,138,407 | 11/1938 | Huck | 101/183 |
| 2,788,738 | 4/1957 | Wood | 101/171 |
| 3,389,657 | 6/1968 | Schwabach | 101/232 |

FOREIGN PATENT DOCUMENTS

| | | | |
|---|---|---|---|
| 454950 | 1/1928 | Fed. Rep. of Germany | 101/408 |
| 0052655 | 3/1984 | Japan | 101/DIG. 27 |

*Primary Examiner*—J. Reed Fisher

*Attorney, Agent, or Firm*—Browdy and Neimark

[57] ABSTRACT

A continuous, multi-chromatic and multi-productive press consists of two cycling conveyor systems, one of which is responsible for transmitting sheets of paper piece by piece for printing and the other multi-layer cycling conveyors are used to carry the printing pattern plates. The two conveyor systems are installed next to each other and those conveyors are also moving toward each other, in such a way that those printing plates print one each paper between several sets of rollers continuously as long as those conveyors are cycling, and the completed papers can be dropped and piled up automatically in the last step.

1 Claim, 6 Drawing Figures

FIG2-A
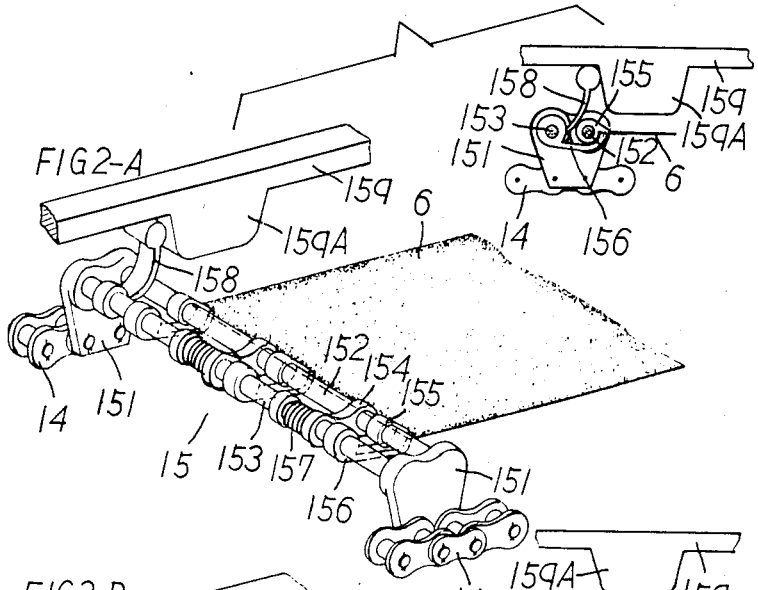
FIG2-B
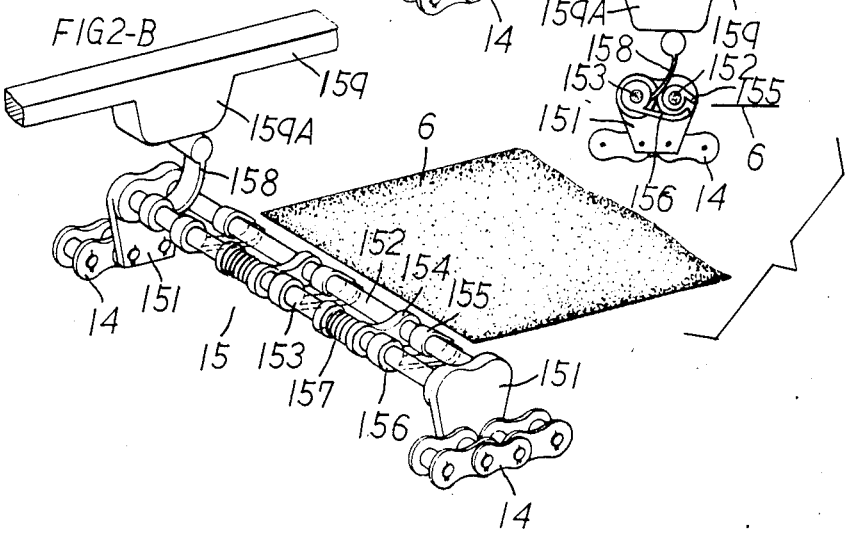
FIG2-C
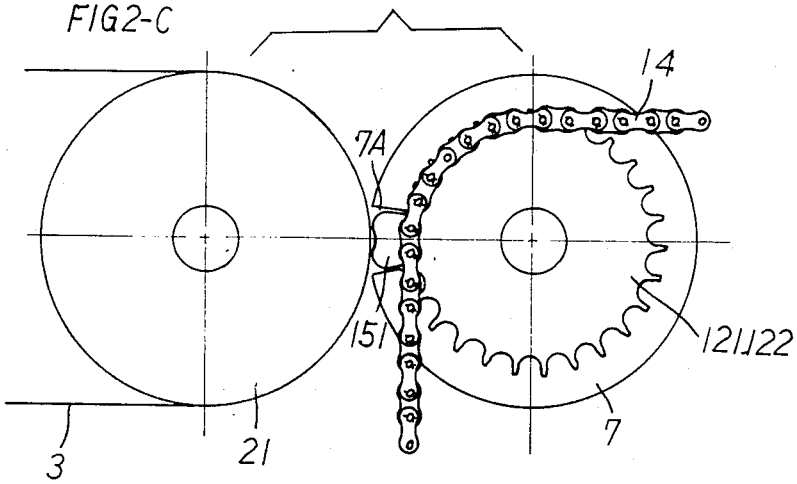

CONTINUOUS, MULTI-CHROMATIC AND MULTI-PRODUCTIVE PRESS

The present invention relates to an important break through in the technique of the conventional single sheet, chromatic printing, and more particularly refers to a continuous, multi-chromatic and multi-productive press.

SUMMARY OF THE INVENTION

The whole idea is based on two cycling belt-conveyor systems, of which one is responsible for providing the papers piece by piece, continuously, and the other multi-layer system carries a number of analogous pattern plates lining up consecutively at a proper distance on each layer with a different kind of plate lined up on each individual conveyor. The multi-layer conveyor system is arranged in a parallel, vertical order and is installed on several parallel rollers. From picking up the sheets of paper piece by piece with a paper-clutching mechanism and transmitting by conveyor the papers to the places between those press roller where the printing steps are carried out, to the piling up of the finished papers, the whole procedure proceeds automatically without any manual interruption.

It is known that conventional offset printing permits only mono-chromatic printing in one single execution. In the case of multi-chromatic printing on one paper, it is necessary to carry out the printing with manual arrangements in several steps which often lead to defects, such as overlapping or separation of colors building up on a paper owing to the shifts of printing plates moving at high speed.

In the present invention there is shown a continuous, multi-chromatic and multi-productive press which eliminates most of the conventional drawbacks in a printing press.

BRIEF DESCRIPTION OF DRAWINGS

FIG. 1A is a flow chart showing three printing patterns printed on a blank paper in three steps;

FIG. 1B is an enlarged perspective of a rear portion of the belt conveyor carrying printing patterns;

FIG. 2A is an enlarged illustration of a paper-fetching mechanism in the act of picking up a piece of paper;

FIG. 2B is an enlarged illustration of paper-fetching mechanism in the act of releasing the paper;

FIG. 2C is an illustration of the interrelationship between a press roller and a front guide roller in a position of a paper-fetching mechanism housing in a groove to avoid the squeezing between the two rollers in the process of printing.

Figure 1:
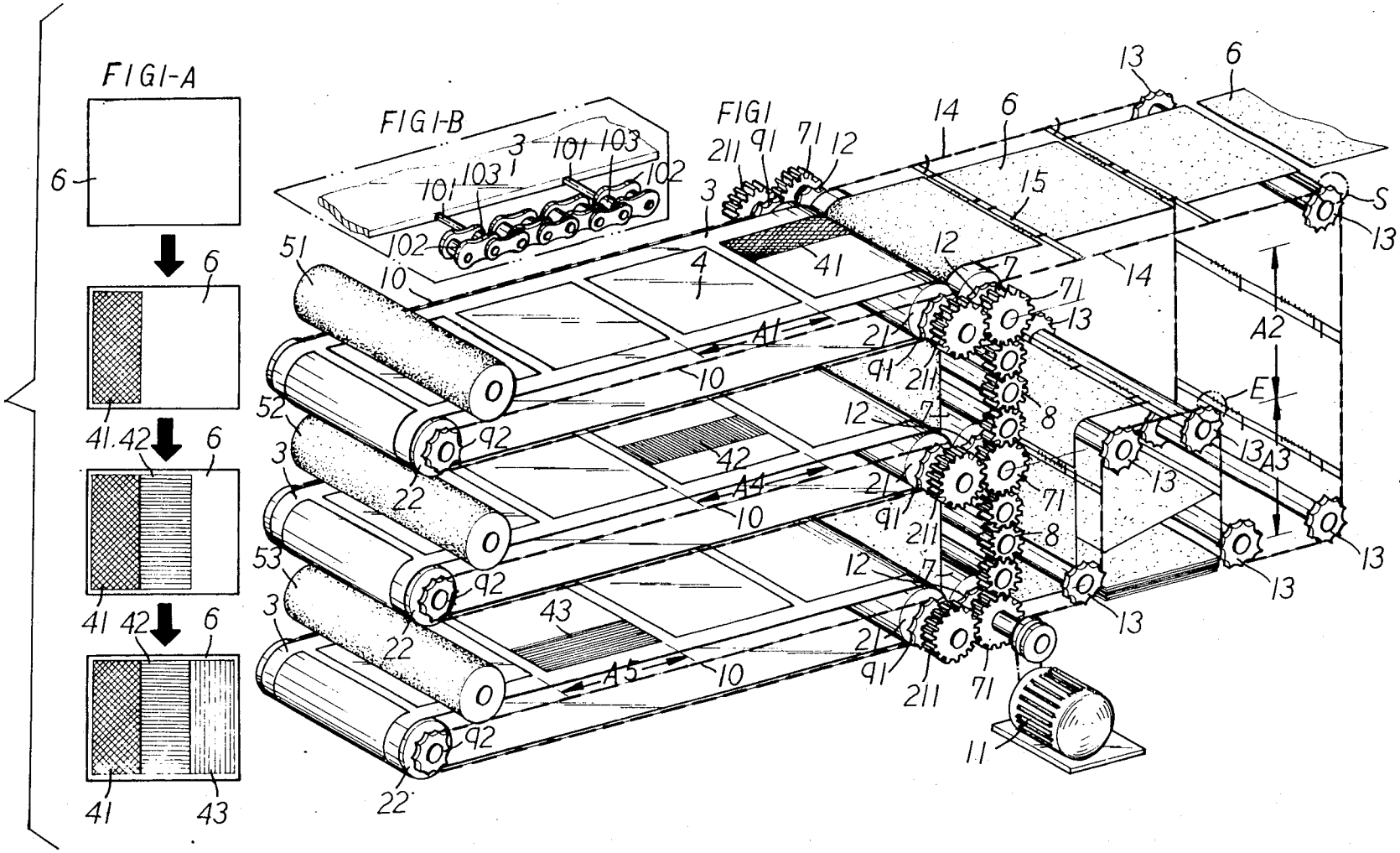
FIG. 1 is a structural layout of the invention.

To best illustrate each of the functional elements that count, components irrelevant to the function of the mechanism may be omitted from the drawing.

DETAILED DESCRIPTION OF THE PREFERRED EMBODIMENT

Referring to FIG. 1 it will be seen that basically the present invention consists of a plurality of color-layer conveyor type composite plate structures on the left side in coordination with recycling clutching structure on the right side thereof, for which the description goes as follows:

As regards the plurality of color-layer conveyor composite structure, it is composed of a number of parallel, descending sets of color-layer conveying belts, each incorporating a pair of symmetrically disposed interior guide rollers 21, 22 and a recycling type plate imposing conveyor 3 supported by and transmitted by the peripheral supports. This serves to obtain different plating color for each layer whether lined up equidistant or not on conveyor 3, of color sorted sheets of bendable material or planar sheet plates 4, for passing past the rolling calendering at the base of respective individually chromatized color drums 51, 52, 53 which abut against the upper side of the respective color layer conveyor.

The rotation of the front wheel of conveyor 3 is transmitted by the engagement of the gear 211 tangentially in contact with a central, outbound axis on one side of the respective forward guide roller 21 with an epicentrically provided outer gear 71 in contact with another central, outbound roller on the same side with the press roller 7 facing the forward guide roller 21; such that it is possible to provide an added number of transmission gears 8, engaged in series and positioned between each of the outer gears 71 so that the gear teeth may rotate uniformly in the same directions. Instead, a continuous chain could be used here.

It has to be pointed out as well that one of outer gear 71, by virtue of the momentum of rotation of the externally bound belt that is subject to movement transmitted by motor 11, provides synchronous transmission of each gear 211, 71 in coordination with respective guide rollers 21, 22 in relation to conveyor 3 in the return direction.

With that achievement each leaf of the sheets of paper 6 spaced apart by its frontal edge on conveyor 3, on passing press roller 7, will be rolled printed by passing in batches on plates 4 on respective color-layers of conveyor 3 in sequence; the color of each sheet printed out on each group of sheet material is determined by the spacing arrangement of each plate 4 in relation to its distance to the centre of each color layer. By taking the embodiment shown in the drawing for illustration it will be seen that the distance from the frontal rim of each unit of a plate 4 out of a triad 41, 42, 43 lined up in rows on the respective color layer conveyor 3, designated by A1, is the same length as the distance from the holding point of both guide roller 21 and press roller 7 to a like holding point therebelow, expressed to be A2, or even to still another like holding point on the same underside, expressed to be A3. Such a distance also equals the layer-by-layer cross-facing spacing A4, A5 from the assembly of plate 41 on the conveyor for each color layer to the plate 42 on the underside and to the other plate on the underside. That is, A1=A2=A3=A4=A5, by this achievement of co-symmetry and flush levelling each sheet of leaf conveyed between the press roller 7 and the conveyor 3 for descending rolling prints will go through a printing procedure like what is shown in FIG. 1A, whereby each edition endued with a different color setting, namely edition 41, edition 42, and edition 43 can be obtained in sequence for competition in good order without additional labor.

As the conveyor 3 is used for precision sheet coloring, stability of movement is a must in this area in order to prevent possible errors arising from vibration at the start-up of operation when the internal coupling with guide rollers 21, 22 alone is utilized. Accordingly the present invention operates with a gear 91 build for rotation about the axis and on the ends of guide roller 21, such a gear 91 in a plane with gear 92 provided for rotation about the axis and on the ends of guide roller 22. This is in order to facilitate securing of a continuous chain 10 thereto, with a view to provide lateral connection for a projection pin 101 fitted by spacing onto the chain 10, with conveyor 3. Such a projection pin 101 appears extending out of the free lateral connection 103 lying between two adjoining sides 102 of a chain link in a setting as shown in detail in FIG. 1B. The gears 91, 92 run in synchronism with gear 211, that is, the chain 10 runs in synchronism with conveyor 3, so as a result, the direction of movement of the conveyor will provide the precision requirements of the color printing.

The continuous type sheet carriage/release feeder ensures that the afore-mentioned sheet 6 will pass smoothly in between the clearance between press roller 7 and guide roller 21 to come out in a volume so that a feeding means has to be provided at the rear of the forward sheetwise roll-out printing unit. By such a provision a full cycle covering the clamping, carrying and release of the sheet 6 throughout the course can be accomplished by fully automatic means. Such provision consists essentially of:

a transmitted gear 12 installed on either side of the projection roller central to the line joining the press roller 7 and the line linking the transmission gear 71 on both of the exterior sides, so as to provide altogether a pair of correlated continuous annular structures on both sides of and for the chain 14 in coordination with a plurality of symmetrically disposed chain gears 13 at the back side thereof, thereby achieving simultaneous, synchronized displacement amount in to rotation. In addition, it has been conceived to provide cross-set free clamping roller 15, whose structure will be described later in the text, having a back-moving chuck port, fixed spaced apart between the two chains 14, in order that on having accepted sheets of printing material 6 one by one on the rear end of the unit, the chuck port will move forward with sheets clamped, into the multi-color, multi-productive rolling printout position between the forward guide roller 21 and the press roller 7. The middle section on the lower side of the continuous chain 14 is set to be a high area from which a port will form and release in the rear the volume of sheets printed out, to drop into folds.

As regards the construction of the free clamping roller 15 and the function of the port engagement-/disengagement reference should be made to FIG. 2A and FIG. 2B, in which it is seen that the said clamping roller 15 is actually a modification of the elastic clipping device used for clamping on both sides of sheets of printing material fed to conventional type of printers for unique holding of the paper sheet on the forward side edge. In structure it comprises essentially an outstanding side piece 151 at a position facing the interior of the chain 14, providing for cross-wise setting of a fixed rear axis 152 and a forward free axis 153, and also for free penetration across space by hanging to a fixed stop-hanger and elastic free axis 153 by means of a number of two-holded hanging rings 154, in order that a number of upper laps 155 distributed on the fixed forward axis 152 together with the downward pointing lap board in front will form a counter-set free chuck port in coordination with an upper pointing tongue extending from the protrusion 156 of the free axis 153. In the meantime with the provision of annular tension spring 157 of like number as the hanging rings 154 having two holes provided on the free axis 153, one end of said spring being fitted to the free axis 153, the other end being fitted to the two-holed hanging ring 154, an elastically compelled force will pull off to force the lap 155 that is in the closure structure that is elastically clamped by the forward end of protrusion 156 to be fed into the frontal side edge of the incoming sheet 6.

Additionally, the side portion of the free axis 153 can be fitted with an upward projection plate 158 which, by means of a control railing 159 positioned higher than the press board 156, will provide bearing force for the control of that part underneath, for closure and opening.

When the base of the control railing 159 goes to a higher position, the projection press board 158 is driven to tuck upwardly. As a result the knob free axis 153 will turn a little bit upwards as well, such that the tip front of the tongue 156 forms an elastic checking closure with the nib of the upper lap 155, this having a uniform carrying effect on the forward side of the paper sheet 6 fed in, like what is shown in FIG. 2A.

In execution a depending projection press point 159A may be provided in the middle section of the control railing 159 in order that when the apex point of the press board 158 bears against the press point 159A to lower while the chain 14 is travelling, it is possible to effect simultaneous braking of the free axis 153 to counter-balance the rebounding force discharged from the tension spring 157, thereby twisting in the reverse direction, so that the forward tongue 156 may come down to form an opening with the nib of the upper lap 155 in preparation for the feeding of sheets, like what is shown in FIG. 2B. It will simply run to the clamping position after passage therethrough. The location of the projection press point 159A is preferably at approximately position S or position E as illustrated in FIG. 1 to serve respectively as the paper releasing point as detailed in the foregoing description.

The free clamping roller 15 sits crosswise between the two external chains 10 and will necessarily have to go through the rotative spacing between each of forward guide roller 21 and pressing roller 7 together with the paper sheet 6 being carried. A depressed co-symmetrical roller groove 7A has to be provided crosswise alongside the press roller 7 as shown in FIG. 2C, in order that it may be shielded in that groove during the time when the free clamping roller 15 passes by the displacement, without affecting the progression and layer multiple printing of the paper sheet 6 carried by its rear end.

To sum up, the invention disclosed a continuous multi-color, multi-productive printer which will achieve simple and thorough color printing without repeated color segregation and with sheet plating with low cost production and economy.

I claim:

1. A continuous multi-productive printer comprising:

a plurality of parallel, vertically layered coplanar conveyor systems disposed symmetrically along the same vertical plane, each conveyor system being essentially identical and comprising:

first and second spaced, parallel, horizontally coplanar cylinders;

an endless conveyor belt looped about said horizontally coplanar cylinders, said endless conveyor belt carrying a plurality of sheet plate holders positioned side-by-side, one side edge of a sheet plate holder and a corresponding side edge of an adjacent sheet plate holder being spaced a distance A apart, the vertical distance between the cylindrical axes of two vertically adjacent and corresponding cylinders being said distance A; and a chromatized color drum abutting against an upper side of said looped endless conveyor belt;

a chain gear on each end of each horizontally coplaner cylinder;

a pair of parallel link chains connected to each side of said looped endless conveyor belt, each one of said pair of link chains being engaged with said chain gears on corresponding ends of said horizontally coplanar cylinders;

a paper feeding unit comprising;

a paper feeding means;

a plurality of press rollers, each press roller being disposed parallel to and horizontally coplanar with a corresponding adjacent first cylinder, each of said first cylinders having one of said press rollers corresponding therewith;

a continuous conveyor mat, having releasable means for clamping individual sheets of paper thereon, extending from said paper feeding means, between spaces existing between each of said press rollers and said corresponding first cylinders, the spaces between said press rollers and said corresponding first cylinders being sufficient to permit joint passage of said sheet plate holder with a sheet plate attached thereto, said endless loop conveyor belt, said conveyor mat and a sheet of paper therethrough and to transfer an image on said sheet plate to said paper sheet, to a delivery means, and back to said paper feeding means, said delivery means comprising means for releasing paper held on said conveyor mat by said clamping means and means for collecting said released paper;

a motor for driving said conveyor belt and said conveyor mat;

a gear means interconnecting said each of press rollers and each of said first cylinders so that said conveyor mat and all of said conveyor belts move synchronously at the same speed, means drivingly connecting said motor to said gear means.

* * * * *